United States Patent [19]

Paurat et al.

[11] Patent Number: 4,470,635

[45] Date of Patent: Sep. 11, 1984

[54] METHOD AND APPARATUS FOR EXCAVATING A TUNNEL OR GALLERY FACE

[76] Inventors: Friedrich W. Paurat, Kasselweg 29; Roland Paurat, Blumenstr. 11, both of 4230 Wesel, Fed. Rep. of Germany

[21] Appl. No.: 461,533

[22] Filed: Jan. 27, 1983

[30] Foreign Application Priority Data

Jan. 29, 1982 [DE] Fed. Rep. of Germany ..... 3202849
Sep. 22, 1982 [DE] Fed. Rep. of Germany ..... 3235009

[51] Int. Cl.[3] ..... E21C 27/24
[52] U.S. Cl. ..... 299/1; 173/4; 173/7; 299/75
[58] Field of Search ..... 299/1, 75; 173/7, 8, 173/4

[56] References Cited

U.S. PATENT DOCUMENTS 2,136,921 11/1938 Joy ..... 299/1
2,711,880 6/1955 McKenzie ..... 173/4
3,548,570 12/1970 Knott et al. ..... 299/1 X
3,734,202 5/1973 Gyongyosi ..... 173/4

*Primary Examiner*—Ernest R. Purser
*Attorney, Agent, or Firm*—Karl F. Ross; Herbert Dubno

[57] ABSTRACT

A method of excavating a tunnel face in which the cutting head is sunk into the face to form an initial penetration and is then moved laterally. The power consumption of the cutting head drive motor is measured, compared with the setpoint value and the attack increment is controlled accordingly. The arm carrying the cutting head is swung at a maximum swing moment but the swing moment is reduced when monitored distortion of machine parts shows that this distortion has exceeded a predetermined value.

9 Claims, 4 Drawing Figures

METHOD AND APPARATUS FOR EXCAVATING A TUNNEL OR GALLERY FACE

CROSS REFERENCE TO RELATED APPLICATIONS

The present application deals with excavation and may be related to the commonly owned copending application Ser. Nos. 334,068 and 334,070, both filed 23 Dec. 1981. Reference may also be had to the following commonly owned U.S. patents in the mining and excavating field:

U.S. Pat. No. 3,729,056
U.S. Pat. No. 3,998,493
U.S. Pat. No. 4,095,845
U.S. Pat. No. 4,080,000
U.S. Pat. No. 4,231,618
U.S. Pat. No. 4,173,836
U.S. Pat. No. 4,247,997
U.S. Pat. No. 4,274,675
U.S. Pat. No. 4,278,293

FIELD OF THE INVENTION

Our present invention relates to the excavation of a mine, tunnel or gallery face, and more particularly, to a tunneling method or machine capable of advancing a tunnel or gallery in a subterranean structure.

BACKGROUND OF THE INVENTION

Partial-cutting machines have been provided heretofore for advancing a tunnel, gallery, drift or other mining or subsurface passage through a subterranean structure by progressively cutting away the face of this structure in the direction in which the tunnel is to be advanced.

The equipment utilized for this purpose can include a cutting head formed with milling teeth and rotatable to bite into the face of the subterranean structure.

Such tunneling apparatus can include a vehicular structure upon which the milling head is carried and which is movable along the floor of the tunnel or gallery, e.g. via crawler treads, a turntable on the vehicle body, an outrigger arm or boom extending from the turntable and swingable thereby, and the cutting head at the end of this boom. The vehicle structure also carries a prime mover and various hydraulic or other apparatus for the movements which are to be effected and the control system.

Such machines may be operated by personnel on or alongside the machine or even by remote control More specifically, the tread or crawler chassis may be displaced by a hydraulic motor driven by a pump connected to the prime mover or by some other transmission interposed between the prime mover and the tread of the tracked vehicle, hydraulic piston-and-cylinder arrangements (hydraulic jacks) may be provided to swing the boom or arm upwardly or downwardly about a horizontal axis, a rotary hydraulic motor also energized by the pump can be provided to drive the turntable to allow swinging of the arm from side to side, and similar hydraulic means can be provided to extend and retract the boom or arm.

The cutting head at the end of the arm may be provided with its own drive, e.g. a hydraulic or electric drive.

In general, such machines have operated in the past to advance a mine tunnel by sinking the head into the tunnel face to a predetermined depth and then swinging the head to one side and/or the other and thereby mill away the subterranean structure beneath an overlying body and above an underlying body. When the cut has been completed over the width of the mine tunnel, the head is moved upwardly or downwardly into the overlying body or the underlying body and the swinging movement is repeated. This process is repeated until the entire face has been cut away by such partial cuts to the aforementioned predetermined depth.

It is useful to define, for the purpose of this disclosure, an "increment" of attack, also referred to as the "attack increment", to mean the area over which the cutting head attacks the structure as it is swung to one side or the other in excavating horizontal cuts in the manner described. This attack increment is, of course, increased by increasing the penetration of the cutting head into the face and will generally be related to the height of the cut and/or to the product of the height and the depth of the cut.

Generally speaking in the earlier systems, once penetration was accomplished to the desired depth, the attack increment was the same for the initial cut and for the cuts thereabove and below until the entire face was excavated to the aforementioned predetermined depth.

During the excavation, the swing moment of the arm can vary and, of course, depended upon the resistance of the structure to the cutting action of the head and to its lateral movement in advancing the cut and thus to the force applied to the arm through the turntable, tending to swing the arm and laterally displace the head.

After the face had been competely cleared, a new penetration was made and the process repeated, thereby advancing the tunnel, gallery or drift by a series of partial cuts. The cutting head itself can have the configuration of a disk such that the depth of penetration corresponded to the thickness of the disk and the disk was oriented orthogonally to the direction of advance, the disks cutting strips whose thickness has defined the attack increment. The cutting head also may be a ball or cone shaped member or even a cylindrical body formed with spherical or helical arrays of teeth.

The penetrataion depth and the attack increment are, of course, selected in dependence upon the type of structure which is encountered, namely, the hardness or softness of the rock strata and other characteristics thereof and determine in turn, the volume rate of flow of the recovered rock i.e. the amount of rock removed from the face per unit time.

In utilizing the aforedescribed technique and machines, the depth of penetration and the attack increment are generally predetermined, based upon observation by the operator, test data from sampling or the like of the hardness of the rock structure or other empirical matters.

Utilizing predetermined and precalculated parameters of this type, however, it is not always possible to optimize the rate of removal of the rock structure. It is difficult, if not impossible, to optimize the cutting efficiency and it is not always possible for the operator to respond sufficiently rapidly to undue stress upon the machine parts or to prevent such undue stresses from reaching critical values or even damaging the apparatus.

OBJECT OF THE INVENTION

It is the principal object of the present invention, therefore, to improve earlier methods of excavating the face of a tunnel, gallery or drift whereby the aforementioned disadvantages can be obviated.

Another object of the invention is to provide a method of advancing a mine face by partial cutting which can be effected with optimum efficiency and this optimum recovery of rock structure from the face without detriment to the outrigger arm or other parts of the machine.

Yet another object of the invention is to provide an improved method of operating an excavating machine of the type described and an improved machine for operation by this method.

SUMMARY OF THE INVENTION

These objects and others which will become more readily apparent hereinafter are attained in accordance with the present invention in a method of operating a tunnel-advancing machine which comprises, as described, a crawler or tracked vehicle chassis, a turntable rotatably mounted on this chassis, an arm extending from this chassis and a cutting head carried by this arm and extending over only a portion of the height and width of a face to be cut away in advancing the tunnel.

According to the method of operating this machine and cutting away the tunnel face according to the invention, the cutting head is driven and thrust into the face to a predetermined penetration depth and then the cutting head is displaced by swinging of the arm to excavate a slot of a width determining at least in part the attack increment by swinging of the arm. When the face is thus cut to the perimeter of the tunnel by movement outwardly from the original penetration, the cutting head can be moved also by this arm transversely to the ledge which is thereby formed to attack a second portion as the head is swung by the arm.

According to the invention, during the partial cutting of the face, the power consumption of the cutting head is measured and a signal is produced to correspond to the measured value, this signal being compared to a signal representing the cutting head power setpoint value which is determined by the construction of the machine and the orientation of its arm, and the resulting deviation is utilized to control the attack increment for further cutting by the swinging movement of the arm. In addition, the swinging of the arm is effected with a maximum swinging moment and any deformation resulting from the swinging of the arm of the machine parts taking up the reaction force is detected and upon exceeding a predetermined limiting value, the swinging moment is reduced.

More specifically, the initial and subsequent partial cuts are horizontal, i.e. the cutting head is sunk into the mine face to the aforementioned predetermined depth and then, by rotation of the turntable in one sense or the other, and preferably alternately in both senses, the first horizontal partial cut is made leaving a ledge above this partial cut and a ledge below this partial cut, constituting the upper and lower bodies previously mentioned.

By then vertically displacing the arm, i.e. swinging the same about its horizontal axis upwardly or downwardly, either of these ledges can be attacked. Since the power consumption of the cutting head is measured during each partial cutting operation, the power consumption values (representing the load of the cutting head) can be compared with the setpoint value during all of the cutting stretches and the attack increment varied during the course of each cutting stretch, e.g. by retracting or advancing the cutting head to modify somewhat the depth of penetration from the original depth T.

In this preferred or best mode embodiment of the invention, the partial cuts are horizontal and after, say, all of the upper ledge structure has been removed over the full width of the tunnel face, all of the lower ledge structure can be removed with smaller horizontal cuts or vice versa.

When the entire face is cut away to the depth T or substantially to this depth, the cutting head is used to sink another penetration in the newly formed face and the process is repeated to advance the tunnel.

According to the invention, negative deviation of the cutting head power consumption (actual deviation) from the setpoint value, the attack increment is increased, i.e. the penetration is increased, while with a positive deviation of the measured value of the power consumption of the head from the setpoint value, the attack increment is decreased.

The reaction of the swing moment on the machine part supporting the arm can be measured by, for example, anchoring part of the chassis to the ground and detecting the degree to which this part of the chassis tends to move relative to the floor of the tunnel as the arm is swung in its cutting operation.

To this end, a stake can be driven into the floor of the tunnel and connected to the chassis, this stake being provided with strain gauges or the like for measurement of its deformation. Alternatively, strain gauges or the like may be provided on a part of the chassis carrying the stake and its deformation can be measured.

In another approach, the deformation of the arm itself can be measured, e.g. with strain gauges mounted directly thereon or provided at its pivots.

According to a feature of this invention, the cutting head is driven by an electric motor and the power consumption (power demand) of the electric motor is detected by measuring the electric current flow thereto and this value is utilized to operate a hydraulic circuit for controlling the attack increment.

It has been found that the measurement of the reaction effect of the moment with which the arm is swung generally can operate within the elastic deformation range of a number of parts effected by this reaction and hence any of these parts can be provided with strain gauge strips or the like whose electrical resistance is affected by the strain upon the arm and the reaction system supporting same.

The system has been found to be highly advantageous because it permits operation with optimum efficiency and hence generates an optimum flow of the mineral material from the face of the mine tunnel, drift or gallery. Indeed, the optimum results are obtained without any danger to the boom or the parts supporting it.

The method of the invention permits the use of modern control technology and devices without difficulty, since the entire system can be controlled by microprocessors or the like in the same manner as these are used in commercial robotics technology. The entire cutting machine thus functions as a measuring device which can be controlled automatically. For each penetration, the machine has a certain orientation which defines a "fixed point" with reference to which all parameters can be measured or determined i.e. all elastic deformations can be taken with reference to this fixed point to permit the swinging moment to be reduced and a threshold or limiting value to be exceeded.

According to another aspect of the invention, the machine of the invention is provided with a cutting head power sensor which is connected to a comparator and to a control device for adjusting the attack increment or setting the attack increment. The comparator includes means for adjusting the attack increment in response to negative or positive deviations of the measured values of the cutting head power from the setpoint. Additional means can be provided to respond to the swinging moment in the manner described. A control device can be provided for the drive element of the vehicle which reduces the drive power with increasing angle of swing, and when a computer control is provided, it can also block any impermissible combinations or parameters.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
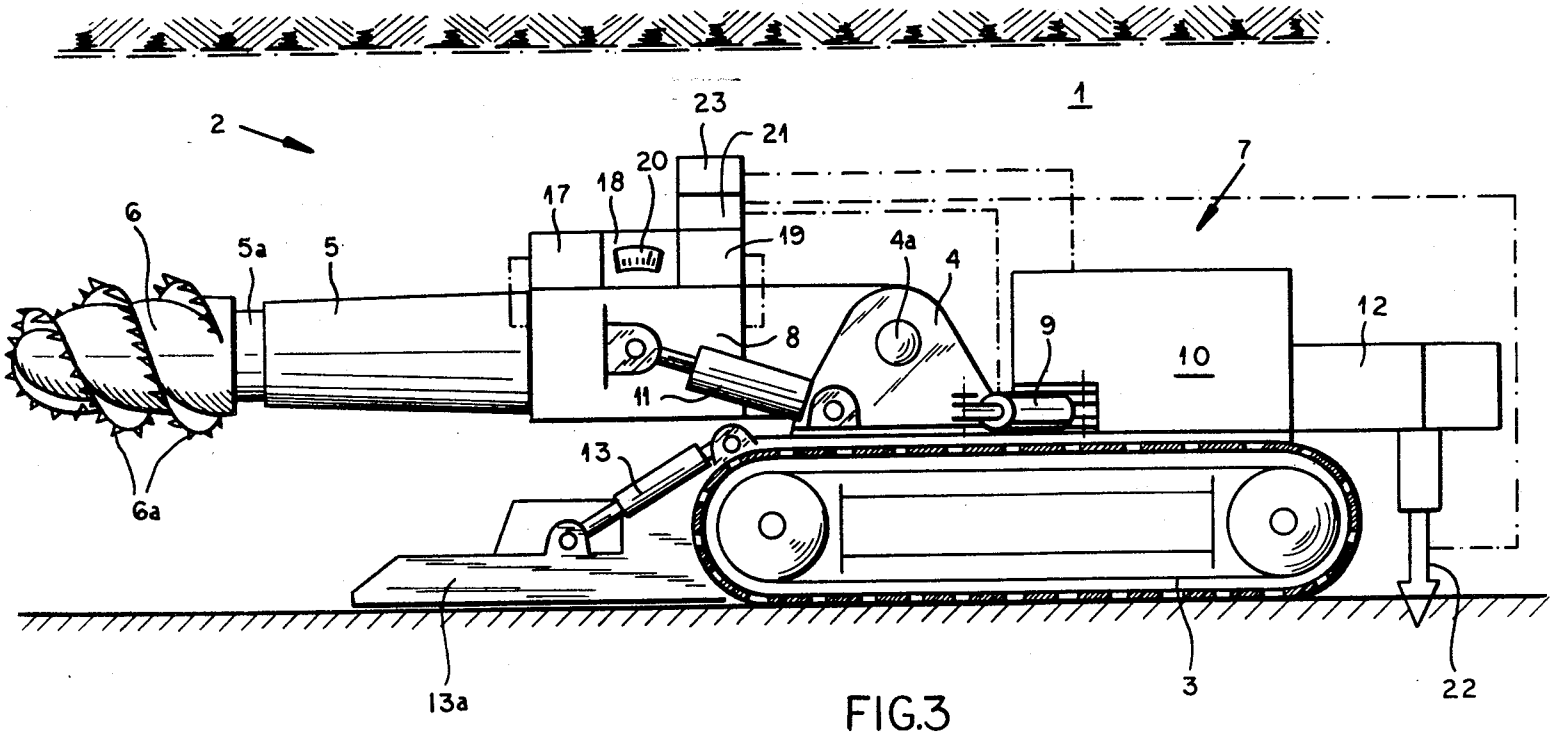
FIG. 3 is a side elevational view diagrammatically showing a machine according to the invention.

The tunnel, drift or gallery 1 in subterranean strata, to be advanced according to the invention by cutting away the face 14 of the tunnel, has been shown in highly diagrammatic form as is the partial cutting machine (FIG. 3).

The machine 2 comprises a track-supported chassis 3 which can be hydraulically driven from a prime mover 100 (FIG. 4) in the form of an electric motor or an engine connected to a hydraulic pump source represented by a pump 101.

The chassis 3 carries as turntable 4 upon which an arm or outrigger 5 is mounted so as to pivot about a horizontal axis 4*a*. The arm 5 is of the telescoping type and has an extensible portion 5*a* operated by a hydraulic cylinder, not shown. The drive assembly is accommodated in a housing structure on the chassis or turntable and is represented at 7. The hydraulic controls regulate a number of drive members. For example, if the hydraulic cylinder arrangement for the telescoping arm 5*a* is represented at 8, it is coupled by means not shown to the drive assembly.

The turntable-rotating hydraulic cylinder arrangement 9, the hydraulic cylinder arrangement 11 connected to the arm 5 for raising and lowering it on the turntable, the hydraulic arrangement 12 for anchoring a stake 22 in the ground and the hydraulic cylinder arrangement 13 for pressing a load carrying foot 13*a* against the ground below the arm 5, all are likewise operated by the drive system. For convenience the drive arrangement for the vehicle whereby it is propelled along the floor of the tunnel has been represented at 10.

In operation, the cutting head 6 which is provided with an electric motor 102 (FIG. 4), and has a helical or spherical array of teeth 6*a* is driven into the face 14 to a mill the recess 15 therein to a predetermined penetration depth T.

Utilizing rotation of the turntable and extension of the arm 5*a*, the cutting head 6 is swung horizontally to cut out the remaining portion of a partial cut represented at $C_1$, and then can be returned in the opposite direction for partial cut $C_2$, thereby separating an upper body or ledge D from a lower body or ledge E by a horizontal cut across the face 14. The arm 5 is raised and the member 5*a* again extended to permit the section D to be cut away by swinging movement of the turntable and extension of the member 5*a*. Then the arm is again raised and the newly formed ledge F can be cut away.

The arm can then be lowered and the lower ledge E can be cut away to be followed by the region G. As these horizontal stretches are each cut away, the side of the tool which is effective is an attack increment which has been represented at V and which represents the lateral surface of the portion being cut away by the swinging movement of the cutting head. The attack increment V has been shown in FIG. 1 for two sections 16. When the entire face has been milled away, the track can advance the vehicle, a further penetration 15 is formed and the process is repeated to advance the tunnel.

After the cutting head has penetrated the face at 15 and the initial portion cut has begun, the power draw of the cutting head is measured and compared with a setpoint value of this cutting head power. With a negative deviation i.e. an actual loading of the tool which is less than the setpoint loading, the attack increment V is increased, e.g. by displacing the tool further into the rock structure.

Upon a positive deviation of the measured value of the cutting head power consumption, the attack increment V is reduced, thereby diminishing the load on the tool At the same time, the swing of the arm 5 is effected with a maximum swing moment, although the deformation of a machine element is measured and upon this deformation by the reaction force of the swing moment exceeding a predetermined limit, the swing moment is reduced.

As can be seen from FIG. 3 in general terms, a cutting head power draw sensor 17 can be connected to a cutting head power draw comparator 18 and to a control device 19 for setting the attack increment.

The sensor 17 measures the electrical power draw provided by the drive, for the cutting head 6 and a setpoint value can be delivered or induced at 20 so that the comparator forms a comparison of the measured and actual values. The controller 19 responds to a negative or positive deviation of the measured value of the cutting head power draw from the setpoint value to increase or decrease, respectively the attack increment V.

At the same time, control unit 21 for the swinging moment of the arm 5 is operative.

This control unit 21 is associated with a measuring bar 22 which is formed as a spike is driven into the floor of the tunnel and is connected to the chassis or arm of the machine so that it deforms as a result of the reaction force upon the arm resulting from the cutting moment.

Thus as the arm 5 swings during application of the cutting moment, a reaction force at the machine frame tends to elastically deform the rod 22 and thus deformation is detected by strain gauge strips or the like (see the description below with respect to FIG. 4) to deliver a signal representing this elastic deformation to the control unit 21 which reduces the swing moment when and if the elastic deformation exceeds a predetermined limit.

Of course the deformation of the arm itself, as measured during the cutting process, can be used as an alternative input to the threshold circuit.

FIG. 3 also shows highly diagrammatically, a control unit 23 for the drive element of the crawler track 3 which can reduce the output of this drive element with increasing swinging angle of the arm.

Thus, while the crawler moves at a certain rate to form the initial penetration 15, a minimum strain is placed upon the arm because this penetration is generally effected with the arm in the median longitudinal plane of the chassis. However, as the arm swings to either side of this plane, the forward movement of the crawler, which is necessary to prevent the head from withdrawing from the generally flat face, is continued but at a reduced rate to minimize the strain.

Figure 1:
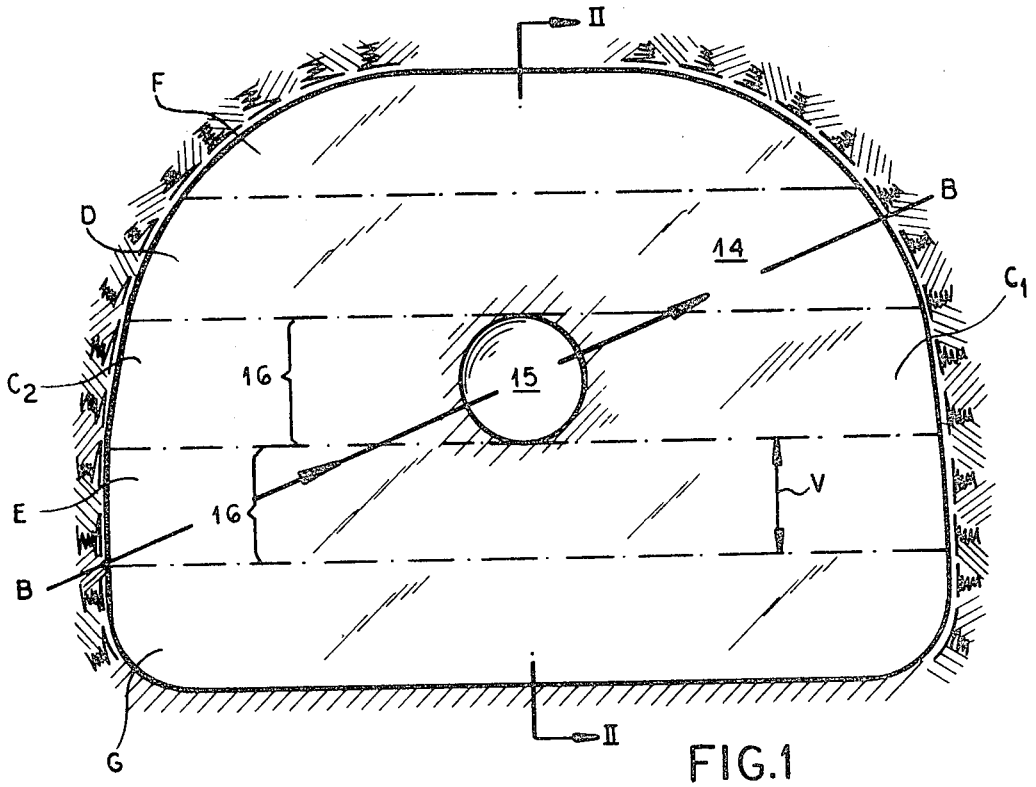
FIG. 1 is an end view of a tunnel, drift or gallery showing the face to be attacked and illustrating the pattern of partial cutting to be effected in accordance with the method of the invention.
Figure 2:
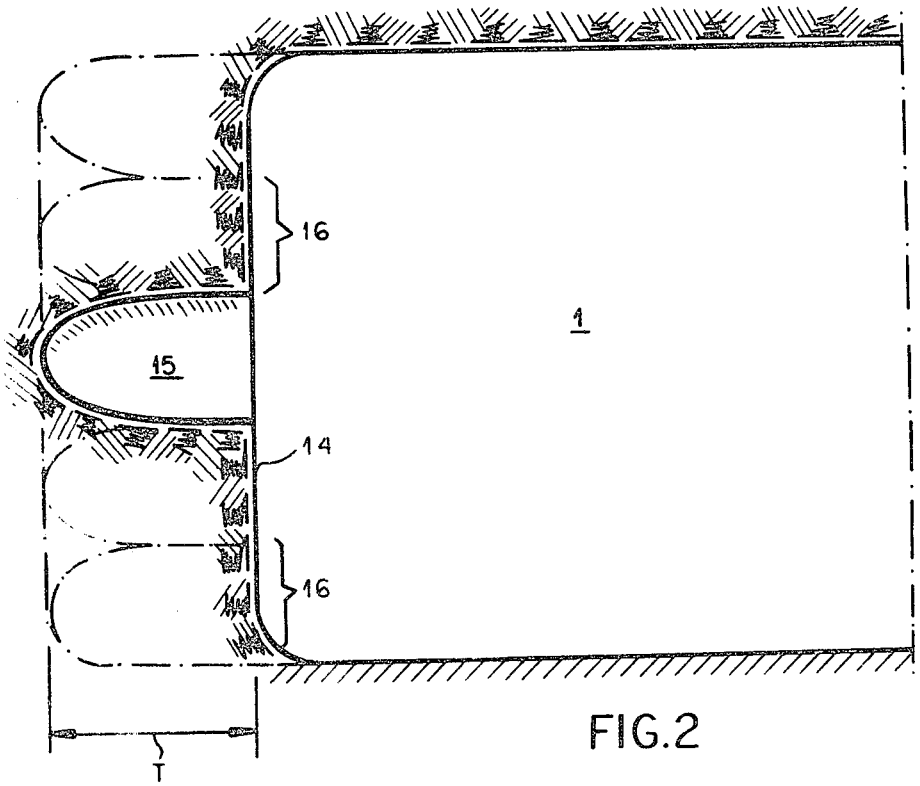
FIG. 2 is a section taken along the line II—II of FIG. 1.

Advantages of the present invention will be apparent especially from FIG. 1 in which the plane B—B represents the orientation of possible tectonic layering of the subterranean strata.

Since the layering of the rock does not coincide with the horizontal cutting stretches, it is possible that the cutting head will have to encounter rock of different types from top to bottom along each cutting stretch. For example, sandstone, clay-sand shale, coal, bituminous shale, sand shale and sandstone in this order or any different order. With the system of the invention, the output is maximized since the attack increment is increased in softer materials as is the setup of the cutting head through these materials, and is reduced for harder materials within each horizontal cutting stretch.

While conventional servomechanism control techniques can be used for the analog portion of the control system (see *Servomechanism Practice,* McGraw Hill Book Co., New York, 1960) and a microprocesssor control system may be used in association therewith (*Digital Computer Circuits and Concepts,* Reston Publishing Co. Inc., Reston, Va., 1980) and these techniques are generally conventional in the art, in FIG. 4 we have shown a circuit which can be employed for this purpose.

Figure 4:
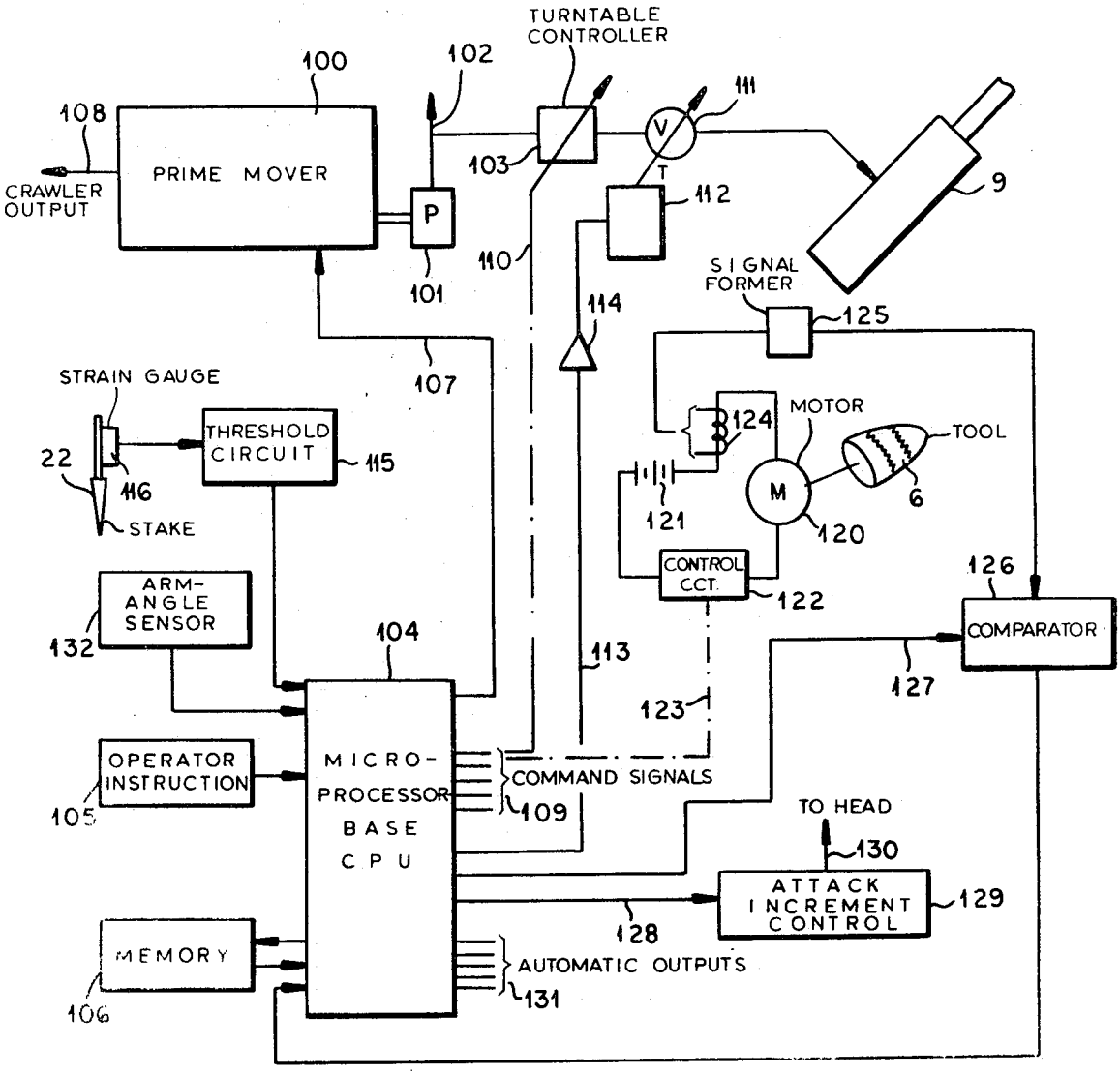
FIG. 4 is a control circuit diagram for operation of this machine.

For example, the prime mover 100 is connected to the previously mentioned pump 101 which supplies the various hydraulic units as presented by the arrow 102 and one unit, namely the jack 9, which is discussed in somewhat more detail in connection with FIG. 4 via a controller 103 which may be operated by the computer microprocessor 104 in response to operator instruments introduced at 105 and in accordance with preprogram responses represented by the memory 106 associated with such instructions.

The microprocessor also controls, as is represented by the line 107, the prime mover 100 and hence the power delivered at 108 to the crawler.

Only the turntable controller 103 has been illustrated and it can be seen that this controller responds to the command signals from the microprocessor represented 109 via the line 110.

The preset instructions for the turntable controller require it to operate at a maximum swing moment unless this swing moment is limited, e.g. via a throttle valve 111 which can be electromagnetically controlled is represented at 112 by the output from the microprocessor 104 represented at 113 and amplified at 114.

The output 113 is delivered by the microprocessor when a theshold circuit 115 delivers an input thereto. The threshold circuit 115, which can be a Schmidt trigger circuit (389–402 ff of *Pulse, Digital, and Switching Wave Forms,* McGraw Hill Book Co., New York 1965), receives its input from a strain gauge sensor 116 on the stake 22 previously mentioned. The strain gauge arrangement can be of the type described at page 343 of *Servomechanism Practice,* op. cit. (See also U.S. Pat. No. 4,223,198). The threshold circuit 115 is set to deliver its output to the microprocessor only upon the distortion of the chassis or body of the machine exceeding a predetermined limit.

The two head 6 in FIG. 4 is shown to be driven by an electric motor 120 in series with a current source 121 and a motor control circuit 122 under digital control (via line 123) from the microprocesssor 104. The current sensor 124, here a current transformer whose output represents the power draw of the motor, is connected to a signal former, e.g. a filter 125 which delivers its output to a comparator 126 to which a setpoint value is delivered at 127 from the microprocessor. With a positive or negative deviation as described, an input is provided to the microprocessor 104 generating an output 128 to an attack increment controller 129 which can drive the head deeper, retract the head somewhat or likewise adjust the attack increment as represented at 130.

Naturally, the microprocessor has other outputs 131 to other elements of the machine which operate in the usual manner and an arm angle sensor can also provide an input to control the output 107 and hence the crawler speed in the manner described. Naturally where the sensors develop analog signals, analog/digital conversion units are provided (see *Digital Computer Circuits and Concepts* op. cit.), and where the microprocessor output is digital but the controlled elements are analog in nature, digital/analog converters are provided.

We claim:

1. A method of operating a partial cutting machine for advancing a tunnel by cutting away a face thereof, said cutting machine comprising a crawler, a turntable on said crawler, an arm pivotally mounted on said turntable, a cutting head adapted to penetrate said face and a drive for said cutting head, said method comprising the steps of:

(a) advancing said cutting head into said face to cause said cutting head to penetrate said face to a predetermined depth;

(b) swinging said arm to excavate a stretch adjacent the penetration while driving said cutting head so that said cutting head operates with an attack increment to and separates bodies of subterranean structure on either side of the cut thus formed;

(c) measuring the load on said drive during the formation of the cut and comparing a measured load with a load setpoint and increasing said attack increment when the measured load is less than the load setpoint and decreasing said attack increment when the measured load is greater than said load setpoint;

(d) shifting said cutting head into one of said bodies adjacent a previously formed cut and swingingly displacing said head parallel to the previously formed cut to form an additional cut therein;

(e) repeating step (d) until said face is excavated;

(f) effecting step (c) during all of the cuts of steps (d) and (e);

(g) angularly displacing said arm for each of said cuts in steps (b),(d) and (e) at a maximum swing moment;

(h) detecting deformation of a part of said machine resulting from the reaction to swing of said arm; and (i) decreasing the swing moment applied to said arm upon the measured deformation exceeding a predetermined limit.

2. The method defined in claim 1 wherein the measurement of the deformation is effected by driving a bar of said machine into the floor of the tunnel and measuring the deformation of said bar.

3. The method defined in claim 1 wherein the deformation of said machine is measured by measuring the deformation of said arm.

4. The method defined in claim 1, further comprising the step of decreasing the rate of advance of said crawler with increasing swing angle of said arm.

5. The method defined in claim 1, further comprising the step of varying the penetration of said head in said face to control said attack increment.

6. A machine for the partial cut excavation of a tunnel face comprising a crawler, a turntable on said crawler rotatable about a vertical axis;

an arm swingable about a horizontal axis on said turntable;

a cutting head mounted at an end of said arm;

a drive motor connected to said cutting head;

respective drives for said crawler, said turntable and said arm;

a cutting head power draw sensor connected to said motor and providing an output signal representing the cutting head power draw;

a comparator receiving said signal and a signal representing a setpoint power value for producing an output;

an attack increment controller responsive of said comparator for varying the attack increment of said cutting head in said face with negative and positive deviations of the cutting head power from setpoint power to increase and decrease said attack increment, respectively;

means for controlling the swing moment of said arm; and a detector of distortion of a part of said machine operatively connected to said means for limiting said swing moment upon said distortion exceeding a predetermined level.

7. The machine defined in claim 6, further comprising means for reducing the output of the drive connected to said crawler with increasing swing angle of said arm.

8. A method of excavating a mine face by forming partial cuts therein comprising the steps of:

sinking a cutting head into said face and rotating said cutting head with an electric motor;

horizontally swinging said cutting head during the rotation thereof at the end of an arm with a maximum swing moment to form a partial cut in said face separating upper and lower bodies of rock above said cut;

measuring the power draw of said motor during the formation of the partial cut and increasing the attack increment of said cutting head on the rock during the formation of said partial cut when the power draw of said motor is below a setpoint value and decreasing said attack increment when said power draw is above said setpoint value; and measuring the distortion of a portion of a machine carrying said head and resulting from reaction to the formation of the partial cut and limiting said swing moment upon said distortion exceeding a predetermined value.

9. The method defined in claim 8, further comprising displacing said cutting head successively into the upper and lower bodies to form a plurality of similar partial cuts therein while controlling the attack increment for each of said cuts, until the entire face is removed.

* * * * *